US012304604B2

(12) United States Patent
Guyton

(10) Patent No.: US 12,304,604 B2
(45) Date of Patent: May 20, 2025

(54) STIFF HOLLOW ROD FOR USE TO PROPEL WATERCRAFT

(71) Applicant: Eugene Guyton, Aberdeen, WA (US)

(72) Inventor: Eugene Guyton, Aberdeen, WA (US)

( * ) Notice: Subject to any disclaimer, the term of this patent is extended or adjusted under 35 U.S.C. 154(b) by 511 days.

(21) Appl. No.: 17/776,147

(22) PCT Filed: Nov. 16, 2020

(86) PCT No.: PCT/US2020/060776
§ 371 (c)(1),
(2) Date: May 11, 2022

(87) PCT Pub. No.: WO2021/097445
PCT Pub. Date: May 20, 2021

(65) Prior Publication Data

US 2022/0396343 A1 Dec. 15, 2022

Related U.S. Application Data

(60) Provisional application No. 62/935,549, filed on Nov. 14, 2019.

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS

| | | | | |
|---|---|---|---|---|
| 3,800,734 | A | 4/1974 | Whang | |
| 7,309,364 | B1 * | 12/2007 | Wagenknecht | B63H 16/04 440/101 |
| 2008/0057802 | A1 * | 3/2008 | Wilkinson | B63C 9/28 416/70 R |
| 2011/0065341 | A1 * | 3/2011 | Potter | B63H 16/04 440/101 |
| 2013/0079172 | A1 * | 3/2013 | Roger | F15D 1/10 473/228 |
| 2013/0230398 | A1 | 9/2013 | Hall | |
| 2016/0082335 | A1 * | 3/2016 | Van Dyck | B63B 32/70 446/153 |
| 2021/0253212 | A1 * | 8/2021 | Dufault | B63H 19/00 |

OTHER PUBLICATIONS

Dconbluez, "DIY Kayak Paddle Drip Rings", Nov. 17, 2015, 5 pages, www.instructables.com/id/DIY-kayak-paddle-drip-rings/?ALLSTEPS , World Wide Web, US.

Nick Tomecek, "Paddleboard Joust", Aug. 7, 2013, 1 page, www.tucson.com/paddleboard-joust/image_13b48e48-ff73-11e2-a877-001a4bcf887a.html , World Wide Web, US.

* cited by examiner

*Primary Examiner* — Andrew Polay
(74) *Attorney, Agent, or Firm* — Howard Russell

(57) ABSTRACT

Hollow rod for propelling a watercraft, such as a stand-up paddleboard, comprising: a rigid hollow rod comprising a center section of reduced diameter cross-section suitable for gripping and manipulating by a user's hands; and two, preferably symmetrical, ends of larger diameter suitable for alternating insertion into the water, allowing the water and air to free-flow through the hollow rod, thus providing a means of propulsion as the user pulls on the inserted portion of the rod along the side of the watercraft.

6 Claims, 4 Drawing Sheets

STIFF HOLLOW ROD FOR USE TO PROPEL WATERCRAFT

CROSS-REFERENCE TO RELATED APPLICATIONS

The present application claims priority to and benefit of provisional U.S. application No. 62/935,549 filed on Nov. 14, 2019.

TECHNICAL FIELD

The present invention relates to a device for manual use by a user for imparting motion to a watercraft, such as preferably a stand-up paddleboard (SUP) with reduced effort and greater efficiency than a traditional flat-bladed paddle, and more particularly to a uniquely-shaped and designed stiff rod able to impart such motion more efficiently to such a watercraft than a traditional flat-bladed paddle.

Background Art

Paddling watercraft such as a stand-up paddleboard (SUP) involves balance and skill, and the paddle chosen by the user has had a large effect on the efficiency and enjoyment of the experience. Current paddles have been comprised of a rigid, typically round cross-section, bar, or rod, with a flat blade at one end or both ends of the bar, or rod, the flat blade portion having been designed to have been inserted in the water, the flat blade portion thus being used to propel the SUP and its user along the surface of the water. The length of such prior art rods, and the geometry of such prior art blades have been adjusted to accommodate users' height and weight characteristics, allowing them to be more comfortable with and efficient in the process of paddling. The flat blade, however, has been subject to drag as it has moved through the water, increasing the effort previously required by the user. Various designs of flat blades have been commercialized to provide a compromise between the extra power gained with a larger, or specifically-curved, blade size, or shape, together with the increased drag associated with the larger blade size.

With the use of traditional flat-bladed paddles, however, current users of SUPs have been less efficient and have exerted greater effort to have achieved the same propulsion in the water. This has led to earlier fatigue and associated inability to paddle for longer distances, together with greater frustration for beginners who have been just learning the sport.

To date, paddles have been comprised of a variety of materials. Those of lighter materials, such as carbon fiber, have been deemed to have been more efficient, albeit more expensive. Heaver materials such as aluminum have been used where cost has been an issue. Accordingly, the efforts to improve efficiency have been focused on the use of lighter, but preferably more rigid, materials, while having maintained the traditional tradeoff between flat-bladed paddle size and drag. Therefore, there has been needed a device that accomplishes an increase in paddling efficiency through an improved design in the paddle itself.

Disclosure of Invention

In accordance with an aspect and embodiment of the disclosure, there is provided an apparatus for propelling watercraft, such as a stand-up paddleboard. Such an apparatus comprises a rigid hollow rod of annular cross-section, comprised of aluminum, fiberglass, carbon fiber, wood, or other suitably strong and rigid material, and comprising a center section of reduced diameter cross-section suitable for gripping and manipulating by a user's hands; and two ends of larger diameter suitable for alternating insertion into the water and stroking motion on either side, or both sides, of the watercraft. Said hollow rod allows for the free flow of water and air within the rod as the ends are alternately inserted into and stroked in and against the water. In order to provide a consistent means of propulsion, the two ends are preferably symmetrical in diameter.

In one aspect and embodiment of the disclosure, the hollow rod may further comprise a soft padded layer on at least one end of the rod, such padded layer is adapted to allow the free flow of water and air through the rod. The padded layer provides cushioning for pushing off from other surfaces, such as piers, docks or boats, while safely protecting such other surfaces. Such a padded layer may also provide additional flotation for the hollow rod to allow easy retrieval from the water if the rod is dropped. Such a padded layer also provides a safer means of enabling jousting among others using stand-up paddleboards or other watercraft.

In another aspect and embodiment of the disclosure, the hollow rod may comprise at least two detachable portions, where each hollow rod portion may be securely and rigidly interconnected with the other hollow rod portion or portions to form a single rigid and hollow assembly, such assembly preserving the characteristics of a single hollow rod adapted to allow the free flow of water and air within the rod. Thus it is conceivable that a hollow rod in accordance with one or more aspects of the invention may comprise one, two, three, or more portions able to be assembled with sleeve-like detachable interconnections as further described herein.

In another aspect and embodiment of the disclosure, the length and thickness of the rod will be adjusted for the height and weight of the user. As an example, when the inside diameter of the ends of the rod is 3 inches, with a wall thickness of 1/16 of an inch and an overall length of 15 feet, the rod would be suitable for a person from 5'6"(168 cm) to 6'1"(185 cm) tall and weighing between 150 and 250 pounds.

It will be appreciated by those skilled in the art that there are various possible combinations of the above-described elements and sub-elements for various embodiments of the invention, whether such elements and sub-elements be combined in whole or in part, which may be employed without departing from the scope and spirit of the invention as claimed. Thus, for example, this invention provides the SUP user with a motivating, or propulsion, device that is physically less strenuous to manipulate through water than a flat-bladed paddle because water is allowed to enter each end of the rod as it is dipped into the water, and this provides a dual motivating, or propelling, motion upon paddling or stroking that requires less effort for a given propulsion. Further, it will be appreciated that round, or circular, cross-sectioned ends of the stiff rod are not absolutely necessary for the invention to improve paddling efficiency, but the rod ends may be made with a slight elliptical shape as well without departing from the invention as claimed.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

BRIEF DESCRIPTIONS OF DRAWINGS

MODES FOR CARRYING OUT THE INVENTION

Figure 1:
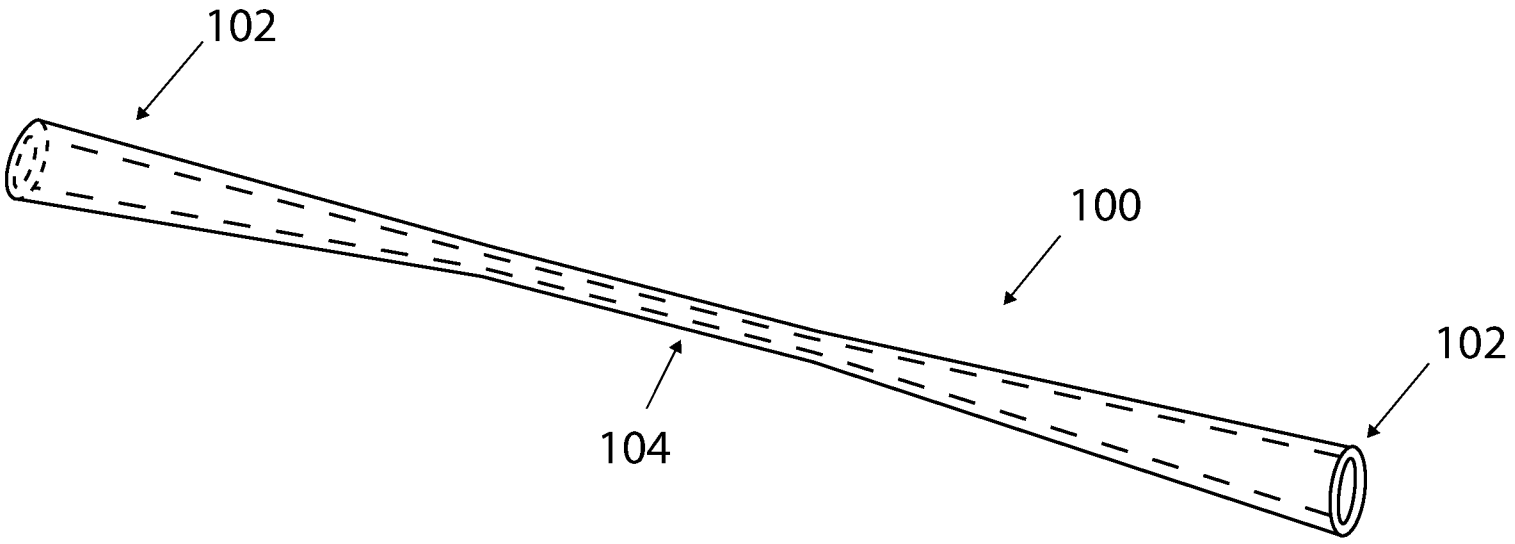
FIG. 1 is a perspective view of a stiff hollow rod, showing the circular cross-section of the rod with tapering on the ends towards a middle section of preferably constant cross-section width of the middle section to provide comfortable and secure handholds.
Figure 2:
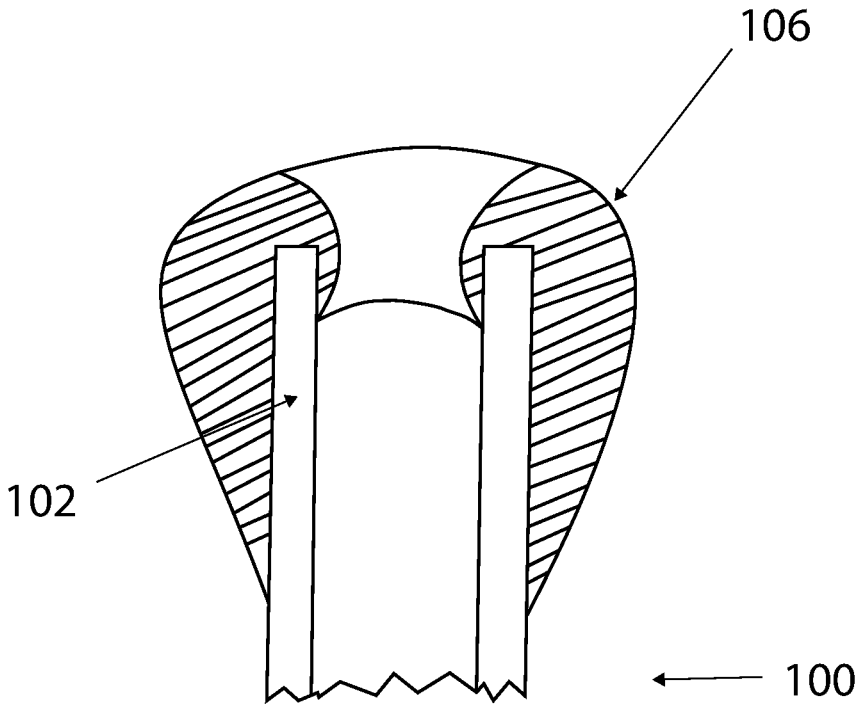
FIG. 2 is a longitudinal cross-section view of the end of the stiff hollow rod of FIG. 1, where soft padding has been added enabling pushing off of other objects, or for jousting games between watercraft, such as stand-up paddleboard (SUP), users.
Figure 3:
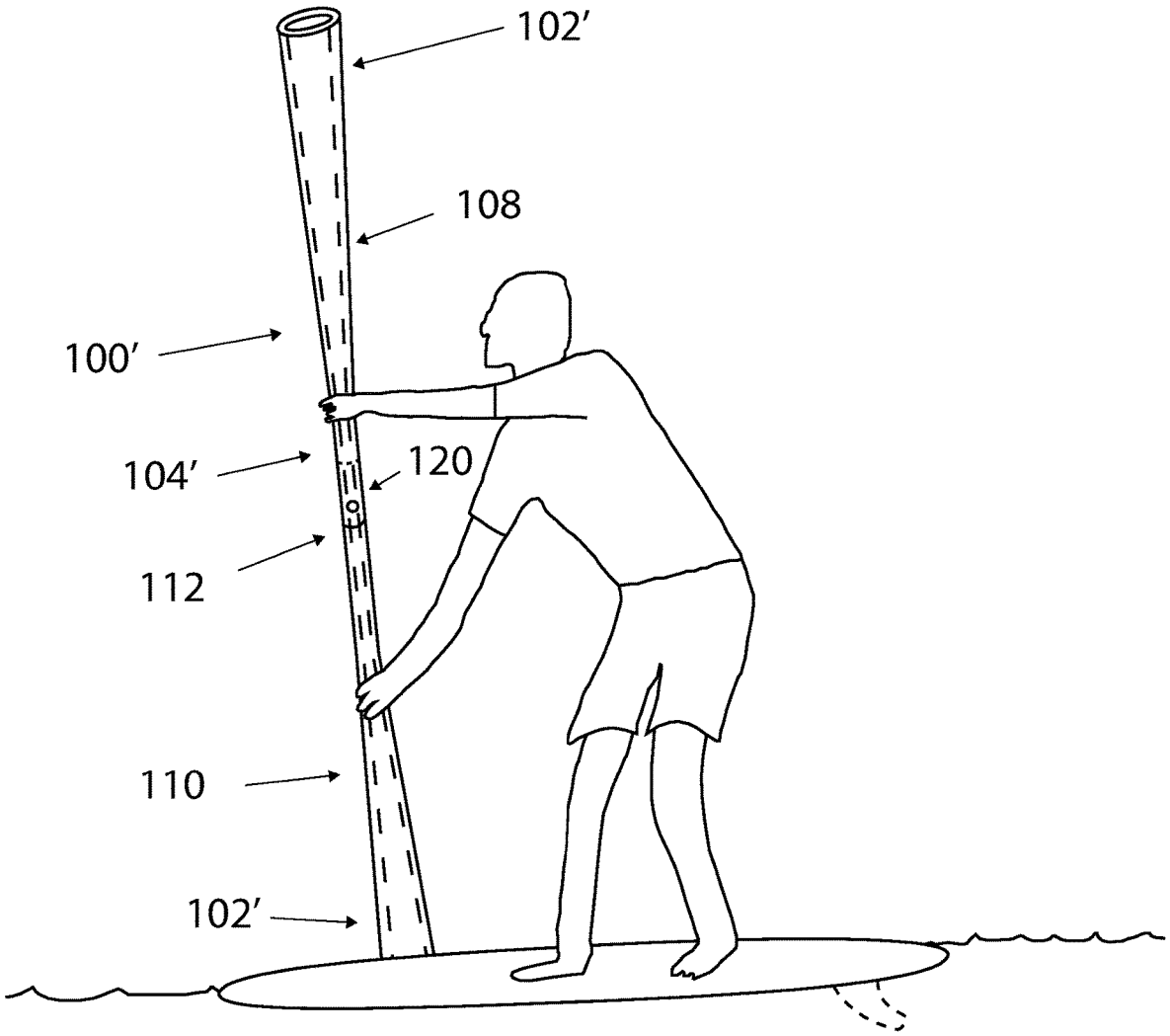
FIG. 3 is a perspective view of an alternative embodiment of a stiff hollow rod provided in segmented portions with a known interconnection device near the middle of the rod and in use as a manual motivating device for propelling a user on a watercraft, such as an SUP, across the surface of water.

Referring to FIGS. 1-3, in accordance with one or more aspects of the invention, there is provided an apparatus comprising: a stiff hollow rod 100 comprising a central section 104 of reduced diameter adapted for gripping and manipulation by a user's hands, and two rod ends 102 of circular cross-section; which stiff hollow rod is hollow throughout its length, allowing for the free flow of water and air.

In accordance with an embodiment of the invention shown in FIG. 2, it is noted that the stiff hollow rod 100 may further comprise a soft padded layer 106, which soft padded layer is firmly attached to at least one rod end 102, and is adapted to allow the free flow of water and air within the stiff hollow rod, while providing cushioning to protect other surfaces that may be contacted.

As shown in FIG. 3, there is provided an embodiment of a stiff hollow rod 100' that is intended to be used by inserting one rod end 102' into the water and pulling the stiff hollow rod with the user's hands located at a narrower hand engaging portion 104' and pulling along the side of the watercraft in a stroking motion, then alternating by inverting the hands and the rod allowing inserting the other end 102' of the stiff hollow rod into the water on the other side of the watercraft and pulling the stiff hollow rod along that side of the watercraft. This embodiment of the stiff hollow rod 100' is segmented into two different portions 108, 110, the two portions being interconnected at a sleeve-like interface 120 between each portion with a spring-loaded ball and socket joint interconnection member 112 as is known in the art.

Figure 4:
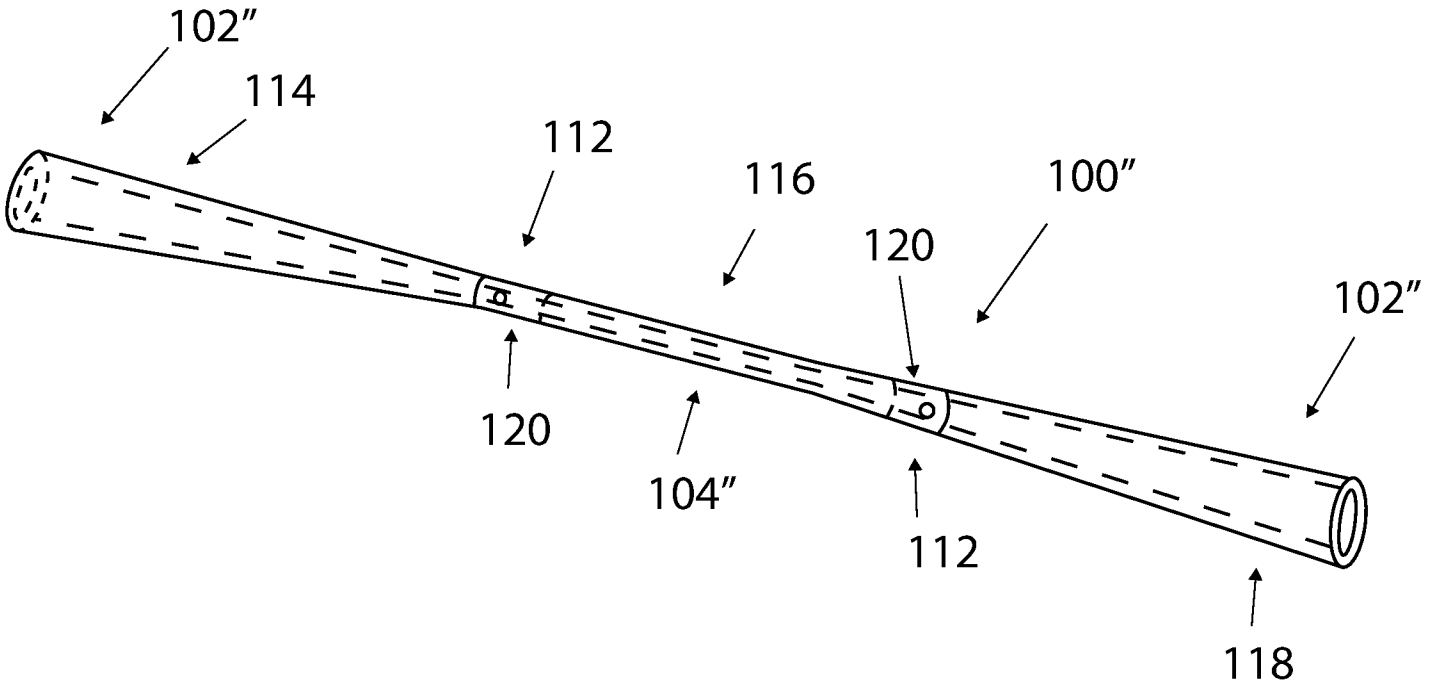
FIG. 4 is a perspective view of another alternative stiff hollow rod provided in three segmented portions with a known interconnection device at the interface of each segment, showing the circular cross-section of the rod with tapering on the ends towards a middle section of preferably constant cross-section width along the length of the middle section to provide comfortable and secure handholds.

As shown in FIG. 4, there is provided an embodiment of a stiff hollow rod 100" that is intended to be used by inserting one rod end 102" into the water and pulling the stiff hollow rod with the user's hands located at a narrower hand engaging portion 104" and pulling along the side of the watercraft in a stroking motion, then alternating by inverting the hands and the rod allowing inserting the other end 102" of the stiff hollow rod into the water on the other side of the watercraft and pulling the stiff hollow rod along that side of the watercraft. This embodiment of the stiff hollow rod 100" is segmented into three different portions 114, 116, 118, the three portions being interconnected at a sleeve-like interface 120 between each portion with a spring-loaded ball and socket joint interconnection member 112 as is known in the art.

While a preferred embodiment of the present invention has been shown and described, it will be appreciated that one of ordinary skill in the art will recognize the inventive principles disclosed are not limited to the embodiments disclosed herein, and that various aspects of the invention may be modified without departing from the true spirit of the invention as claimed. Thus, by way of example, it will be appreciated that this invention provides the SUP user with a motivating, or propulsion, device that is physically less strenuous to manipulate through water than a flat-bladed paddle because water is allowed to enter each end of the rod as it is dipped into the water, and this provides a dual motivating, or propelling, motion upon paddling or stroking that requires less effort for a given propulsion. Further, it will be appreciated that round, or circular, cross-sectioned ends of the stiff rod 100, 100',100" are not absolutely necessary for the invention to improve paddling efficiency, but the rod ends may be made with a slight elliptical shape as well without departing from the invention as claimed. The appended claims are therefore intended to cover all such changes and modifications as fall within the true spirit and scope of the invention.

What is claimed is:

1. An article of manufacture for manually propelling a watercraft, comprising:

a hollow rod of annular cross-section and comprising first and second ends adapted for insertion of each end alternatively into the water, said hollow rod further comprising a center section of reduced diameter of annular cross-section adapted to being gripped and manipulated by a user's hands during a stroking motion on either side, or both sides, of the watercraft while maintaining a free flow of water and air through the rod; and a soft padded layer on at least one end of said rod, wherein said soft padded layer is adapted to not impede the free flow of water and air through the hollow rod during use of the rod to propel the watercraft.

2. The article of manufacture of claim 1, wherein the soft padded layer is adapted to provide cushioning for pushing off from other surfaces while safely protecting such other surfaces.

3. The article of manufacture of claim 1, wherein said soft padded layer provides additional flotation for the hollow rod to allow easy retrieval from the water if the rod is dropped.

4. The article of manufacture of claim 1, wherein said soft padded layer enables jousting among users of stand-up paddleboards.

5. An article of manufacture for manually propelling a watercraft, comprising:

a hollow rod of annular cross-section and comprising first and second ends adapted for insertion of each end alternatively into the water, said hollow rod further comprising a center section of reduced diameter of annular cross-section adapted to being gripped and manipulated by a user's hands during a stroking motion on either side, or both sides, of the watercraft while maintaining a free flow of water and air through the rod, wherein the hollow rod is of circular cross-section.

6. An article of manufacture for manually propelling a watercraft, comprising:

a hollow rod of annular cross-section and comprising first and second ends adapted for insertion of each end alternatively into the water, said hollow rod further comprising a center section of reduced diameter of annular cross-section adapted to being gripped and manipulated by a user's hands during a stroking motion on either side, or both sides, of the watercraft while maintaining a free flow of water and air through the rod, wherein said hollow rod is between 2.5 inches and 3.5 inches in diameter at a widest cross section diameter near each end of said hollow rod, and wherein said hollow rod is between 1 inch and 2 inches in diameter at a widest cross section diameter near a central portion of said hollow rod.

* * * * *